US005246040A

United States Patent [19]

Barwick et al.

[11] Patent Number: 5,246,040

[45] Date of Patent: Sep. 21, 1993

[54] METHOD AND APPARATUS FOR WEAVING AN INDICIA INTO A WOVEN CIRCULAR FABRIC

[75] Inventors: Elvin F. Barwick, Raleigh; Joseph M. Pearce, Angier; Joseph P. Tilley, Charlotte, all of N.C.

[73] Assignee: Angus Fire Armour Corporation, Angier, N.C.

[21] Appl. No.: 866,004

[22] Filed: Apr. 9, 1992

[51] Int. Cl.[5] ..... D03D 37/00

[52] U.S. Cl. ..... 139/459; 139/11; 139/55.1; 139/93

[58] Field of Search ..... 139/387 R, 459, 55.1, 139/11, 93, 50, 18, 19, 14-16, 457, 458, 53, 94, 85

[56] References Cited

U.S. PATENT DOCUMENTS

| | | | |
|---|---|---|---|
| 7,861 | 12/1850 | Thomas et al. | 139/85 |
| 3,815,643 | 6/1974 | Haoya et al. | 139/55.1 X |
| 5,038,836 | 8/1991 | Caramaschi | 139/11 |
| 5,099,891 | 3/1992 | Hirarmatsu | 139/457 |

*Primary Examiner*—Andrew M. Falik

*Attorney, Agent, or Firm*—Rhodes, Coats & Bennett

[57] ABSTRACT

A method and apparatus for weaving an indicia such as a trademark, symbol or design into a tubular fabric. About a selected warp yarn segment of the tubular fabric, for each warp yarn increment, two warp yarns are actually directed into the loom, one warp yarn being a base yarn while the other warp yarn is an indicia forming yarn. The loom is provided with a warp yarn selector that for each pair of base and indicia forming yarns, it selects one and only one of the pair to be interwoven with a weft yarn. The non-selected yarn is essentially positioned such that it is not woven with the weft yarn and runs in a floating or unwoven fashion along the inside wall of the tubular fabric being woven. To provide a selected indicia interwoven in the tubular fabric, the selector is controlled in such a fashion that it causes indicia forming yarns to be woven in areas calling for the indicia background and base warp yarns to be woven in areas that call for the base yarn as a background. As noted, in all cases the non-selected warp yarn of the pair will be floated to run along the inside wall of the tubular fabric.

24 Claims, 9 Drawing Sheets

| | 01 | 02 | 03 | 04 | 05 | 06 | 07 | 08 | 09 | 10 | 11 | 12 | 13 |
|---|---|---|---|---|---|---|---|---|---|---|---|---|---|
| 10 | 0 | 0 | 0 | 0 | 0 | 0 | 0 | 0 | 0 | 0 | 0 | 0 | 0 |
| 11 | 0 | 1 | 0 | 0 | 0 | 0 | 0 | 0 | 0 | 0 | 0 | 0 | 0 |
| 12 | 0 | 1 | 1 | 1 | 0 | 0 | 0 | 0 | 0 | 0 | 0 | 0 | 0 |
| 13 | 0 | 1 | 1 | 1 | 1 | 1 | 0 | 0 | 0 | 0 | 0 | 0 | 0 |
| 14 | 0 | 0 | 1 | 1 | 1 | 1 | 1 | 1 | 0 | 0 | 0 | 0 | 0 |
| 15 | 0 | 0 | 0 | 0 | 1 | 1 | 1 | 1 | 1 | 0 | 0 | 0 | 0 |
| 16 | 0 | 0 | 0 | 0 | 1 | 1 | 1 | 1 | 1 | 1 | 0 | 0 | 0 |
| 17 | 0 | 0 | 0 | 0 | 1 | 1 | 0 | 0 | 1 | 1 | 1 | 1 | 1 |
| 18 | 0 | 0 | 0 | 0 | 1 | 1 | 1 | 1 | 1 | 1 | 0 | 0 | 0 |
| 19 | 0 | 0 | 0 | 0 | 1 | 1 | 1 | 1 | 1 | 0 | 0 | 0 | 0 |
| 20 | 0 | 1 | 1 | 1 | 1 | 1 | 1 | 0 | 0 | 0 | 0 | 0 | 0 |
| 21 | 0 | 1 | 1 | 1 | 1 | 0 | 0 | 0 | 0 | 0 | 0 | 0 | 0 |
| 22 | 0 | 1 | 0 | 0 | 0 | 0 | 0 | 0 | 0 | 0 | 0 | 0 | 0 |
| 23 | 0 | 0 | 0 | 0 | 0 | 0 | 0 | 0 | 0 | 0 | 0 | 0 | 0 |

FIG. 9

METHOD AND APPARATUS FOR WEAVING AN INDICIA INTO A WOVEN CIRCULAR FABRIC

FIELD OF THE INVENTION

The present invention relates generally to methods and apparatuses for circular weaving of tubular fabrics, and more particularly to a new circular weaving method and apparatus for weaving characters, letters and other indicia in a tubular fabric.

BACKGROUND OF THE INVENTION

In weaving flat fabrics, it is fairly common to weave initials or other characters into the fabric. While it is fairly common to weave letters, initials or other designs into a flat fabric, such is not the case for tubular fabrics. Instead, the design is usually stenciled onto the tubular fabric or mechanically printed with an offset printer after it has been woven. However, there are numerous drawbacks to using stenciled designs on tubular fabrics.

One drawback is that stenciling requires additional manufacturing steps which would not otherwise be required. Once the tubular fabric is woven, it must be pressed flat so that the design can be applied. After pressing the tubular fabric, it is stenciled and the ink is given time to dry. These additional manufacturing steps increase the costs of the tubular fabric.

Another drawback associated with stenciled designs on tubular fabrics is that the design may wear off the fabric. For example, tubular fabrics are frequently used as fire hoses or irrigation lines. In these types of applications, the hose or line may be dragged over the ground causing the stenciled design to be worn off.

Accordingly, there is a genuine need for an alternative method of applying designs to tubular fabrics.

SUMMARY AND OBJECTS OF THE INVENTION

The present invention provides a method and apparatus for weaving tubular fabrics with predetermined woven designs. A warp yarn selector is incorporated into a circular loom for manipulating the warp yarns to produce the predetermined design. The circular loom includes a circular comb having a plurality of warp guide slots for guiding the radially extending warp yarns. A shed forming means forms a shed in the warp yarns. The shed is formed by dividing the warp yarns into two sheets and raising or lowering one sheet with respect to the other. A shuttle travels in a circular path inside the comb of the loom and inserts a weft yarn into the shed. When the shed changes, the weft yarn becomes interleaved with the warp yarns to form the tubular fabric.

To make a tubular fabric bearing a woven design, selected warp yarns (referred to herein as the base warp yarns) are paired with an indicia forming warp yarn. The indicia forming warp yarn is of a different color than the base warp yarn and is used to produce the design in the tubular fabric. A warp yarn selector is incorporated into the circular loom to select one warp yarn from each pair of warp yarns to be woven into the tubular fabric. The warp yarn selector includes means for floating the non-selected warp yarn along the inside of the tubular fabric. The non-selected warp yarn is not woven into the fabric, but strings along on the inside of the tubular fabric until it is once again selected to be woven into the tubular fabric.

The warp yarn selector is mounted to the comb or reed of the circular loom and the warp yarn pairs extend through the selector. A catch means is provided for each pair of warp yarns. The non-selected warp yarn is engaged by the catch means and is lifted above the shuttle so that the non-selected warp yarn is not woven into the tubular fabric. In the embodiment described, the catch means comprises an elongated selector rod having first and second catches formed on opposite sides of the rod. A shielding means is provided for shielding the catch of the selected warp yarn while exposing the catch for the non-selected warp yarn. The shielding means comprises a shield rod disposed closely adjacent to the selector rod and having a diameter at least as great as the selector rod. The shielding rod includes first and second cut-outs and is moveable between a raised position and a lowered position. In the lowered position, a first cut-out aligns with a first catch in the selector rod. The other catch is shielded by the shielding rod. In a raised position, the second catch is exposed by the second cut-out in the shielding rod while the first catch is shielded. An electrical actuator is used for moving the shielding rod between the raised and lowered positions. The electrical actuator is controlled by a programmable controller which gets its instructions from a computer.

Based on the foregoing, it is a primary object of the present invention to provide a method and apparatus for weaving tubular fabrics having woven designs in the tubular fabric.

Another object of the present invention is to provide a warp yarn selector for a circular loom for selectively manipulating warp yarns to produce a predetermined woven design in a tubular fabric.

Another object of the present invention is to provide a warp yarn selector which can be incorporated into existing looms without modification to the looms.

Yet, another object of the present invention is to provide a warp yarn selector which is relatively simple in construction and easy to install and use.

A further object of the present invention is to provide a woven fire hose having a woven indicia such as a trademark, symbol or design incorporated therein.

Another object of the present invention is to provide a relatively simple method of weaving indicia such as trademark or symbol into a tubular woven fabric.

Still a further object of the present invention is to provide a method of weaving indicia into a tubular woven fabric that exclusively utilizes warp yarns to form the woven indicia.

A further object of the present invention resides in the provision of a method and apparatus for weaving indicia into a woven tubular product wherein the apparatus is susceptible to being automatically controlled.

Another object of present invention resides in the provision of a system for weaving indicia into a woven tubular fabric that is capable of executing various designs and is also designed in such a manner that the system has the capability of changing from one design to another design during a weaving process.

Still a further object of the present invention resides in the provision of a method for weaving indicia into a tubular woven fabric wherein there is provided special indicia yarns that are selectively woven into the tubular fabric to create and give rise to the indicia and wherein those same indicia yarns are floated to the inside of the tubular fabric along areas where there is to be no indicia.

Other objects and advantages of the present invention will become apparent and obvious from a study of the following description and the accompanying drawings which are merely illustrative of such invention.

BRIEF DESCRIPTION OF THE DRAWINGS

FIG. 9 is a digital illustration of a programmed matrix for forming the letter "A."

DETAILED DESCRIPTION OF THE INVENTION

Figure 1:
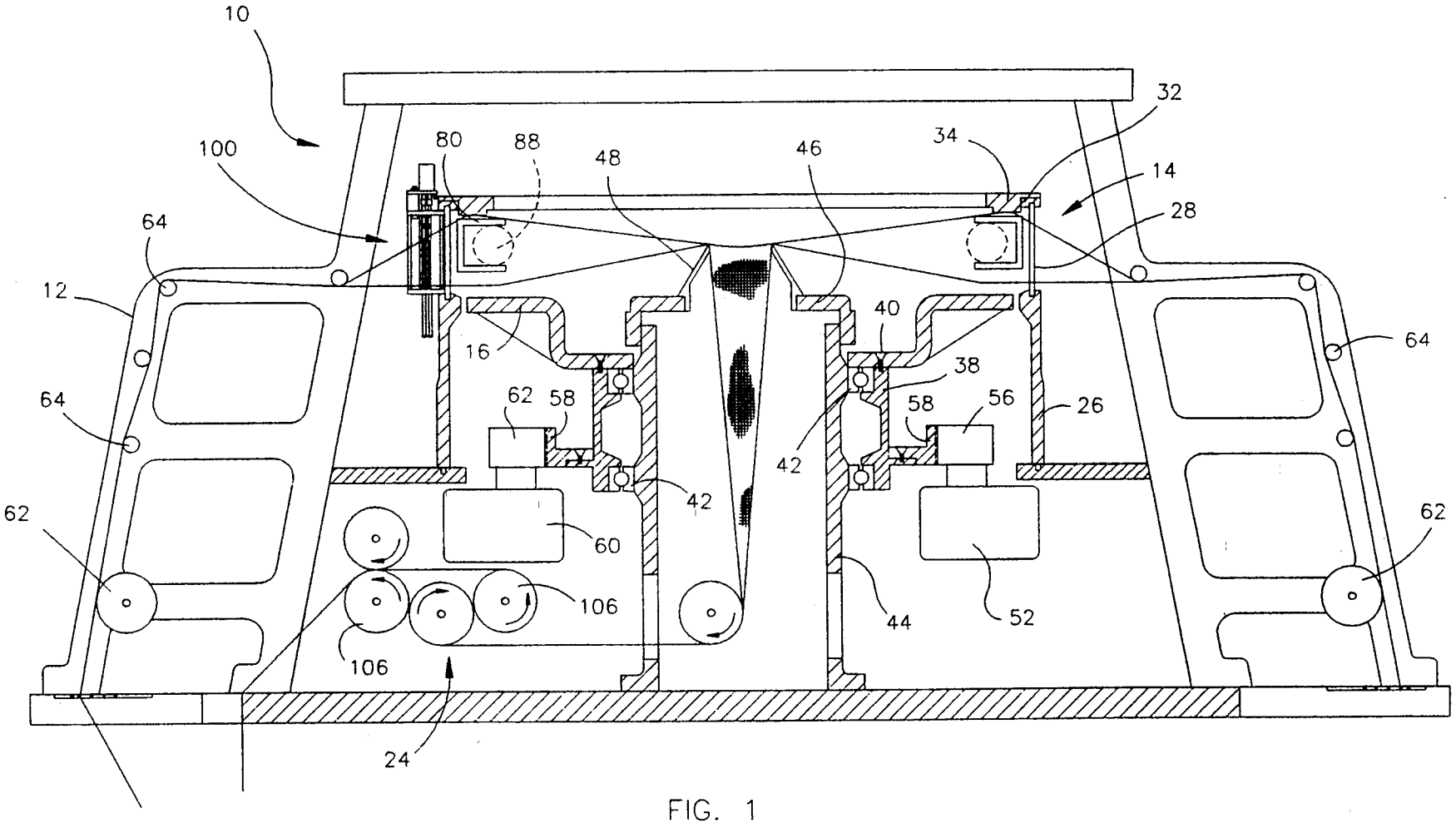
FIG. 1 is a side elevational schematic view of a circular loom with portions broken away to better illustrate the same and wherein the base warp yarn and indicia forming warp yarn selector of the present invention is incorporated into the loom.
Figure 2:
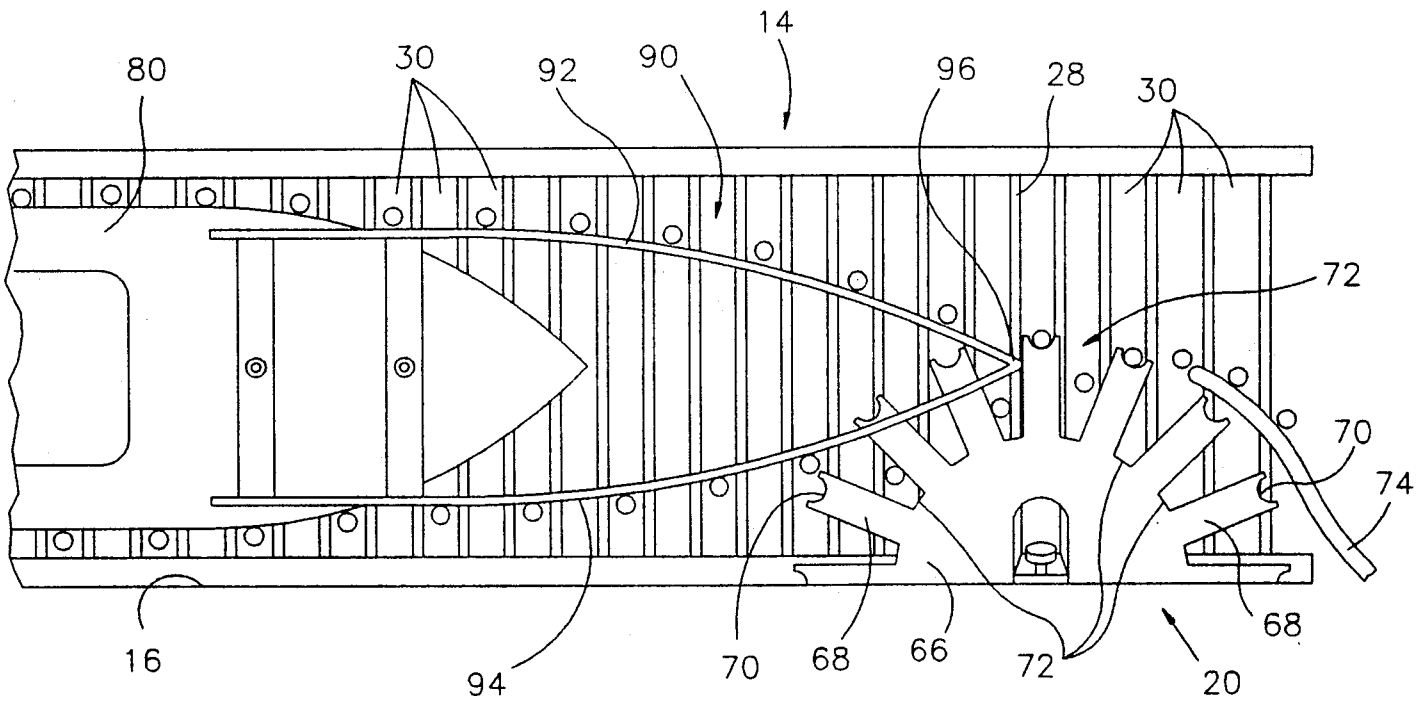
FIG. 2 is a side elevational view of a portion of the circular loom particularly illustrating the shed forming means of the loom.
Figure 3:
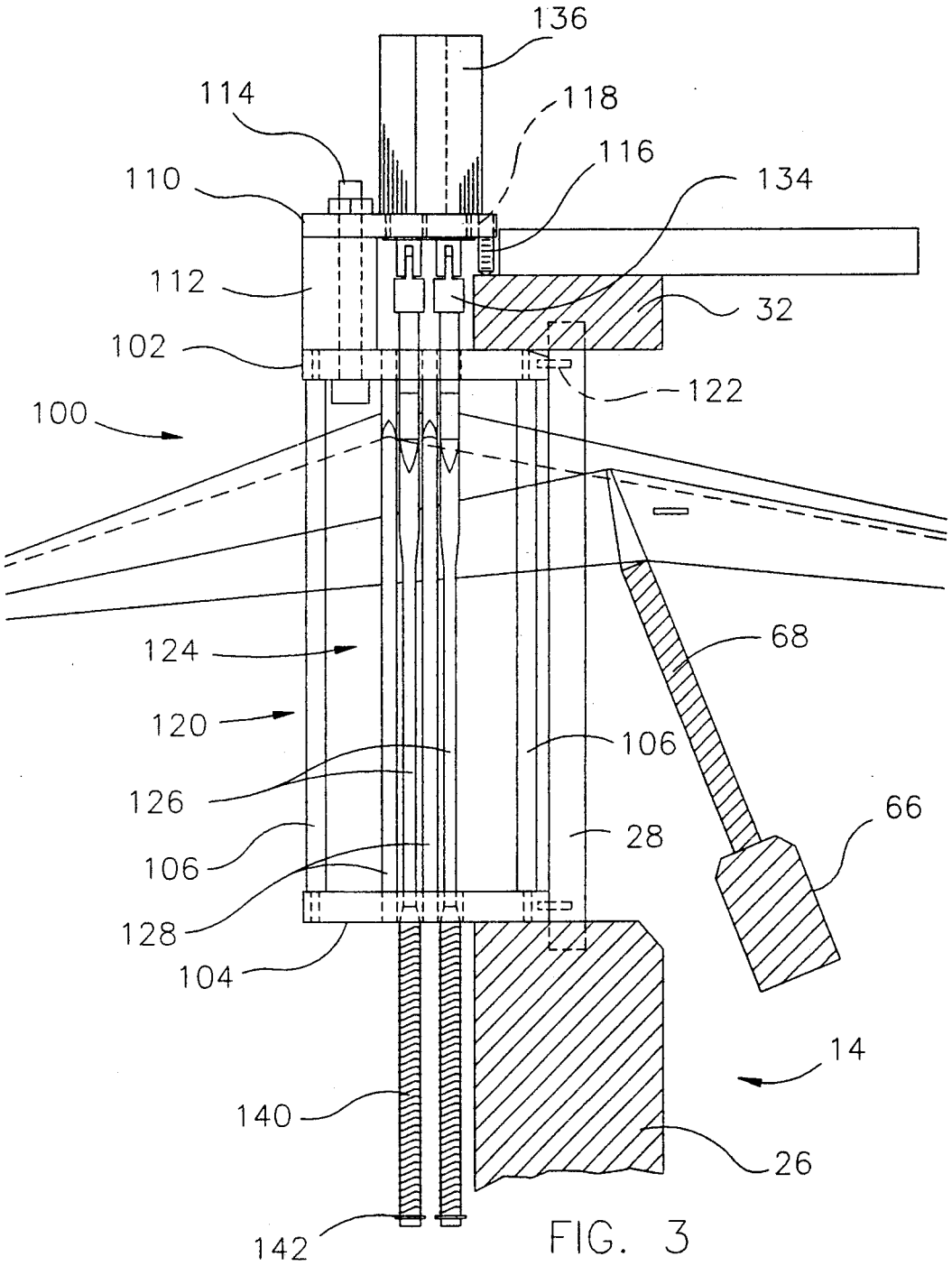
FIG. 3 is a side elevational view of the warp yarn selector of the present invention.
Figure 4:
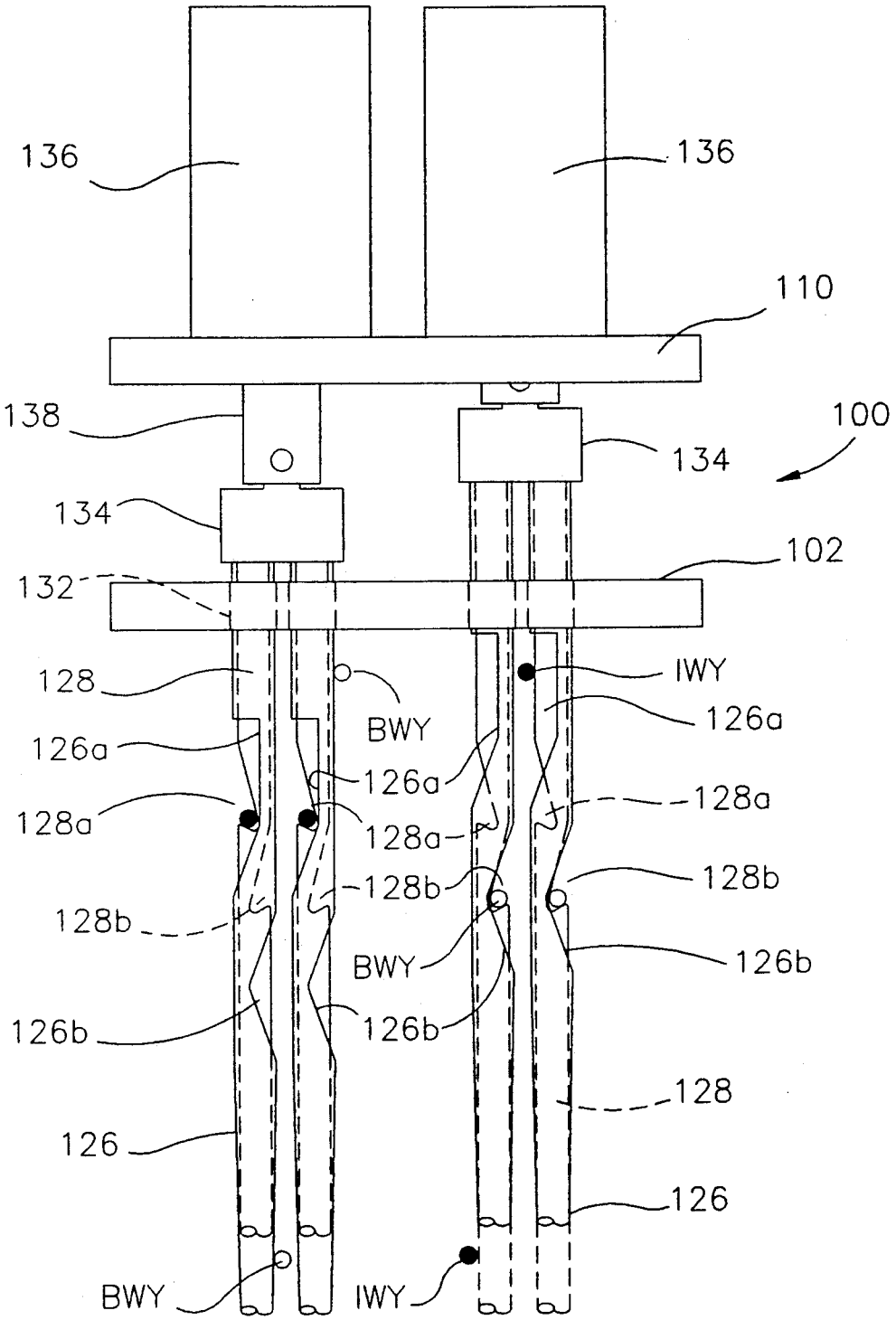
FIG. 4 is a front elevational view of the warp yarn selector of the present invention with the rod that forms the guide slot being removed to better illustrate the structure of the selector.
Figure 5:
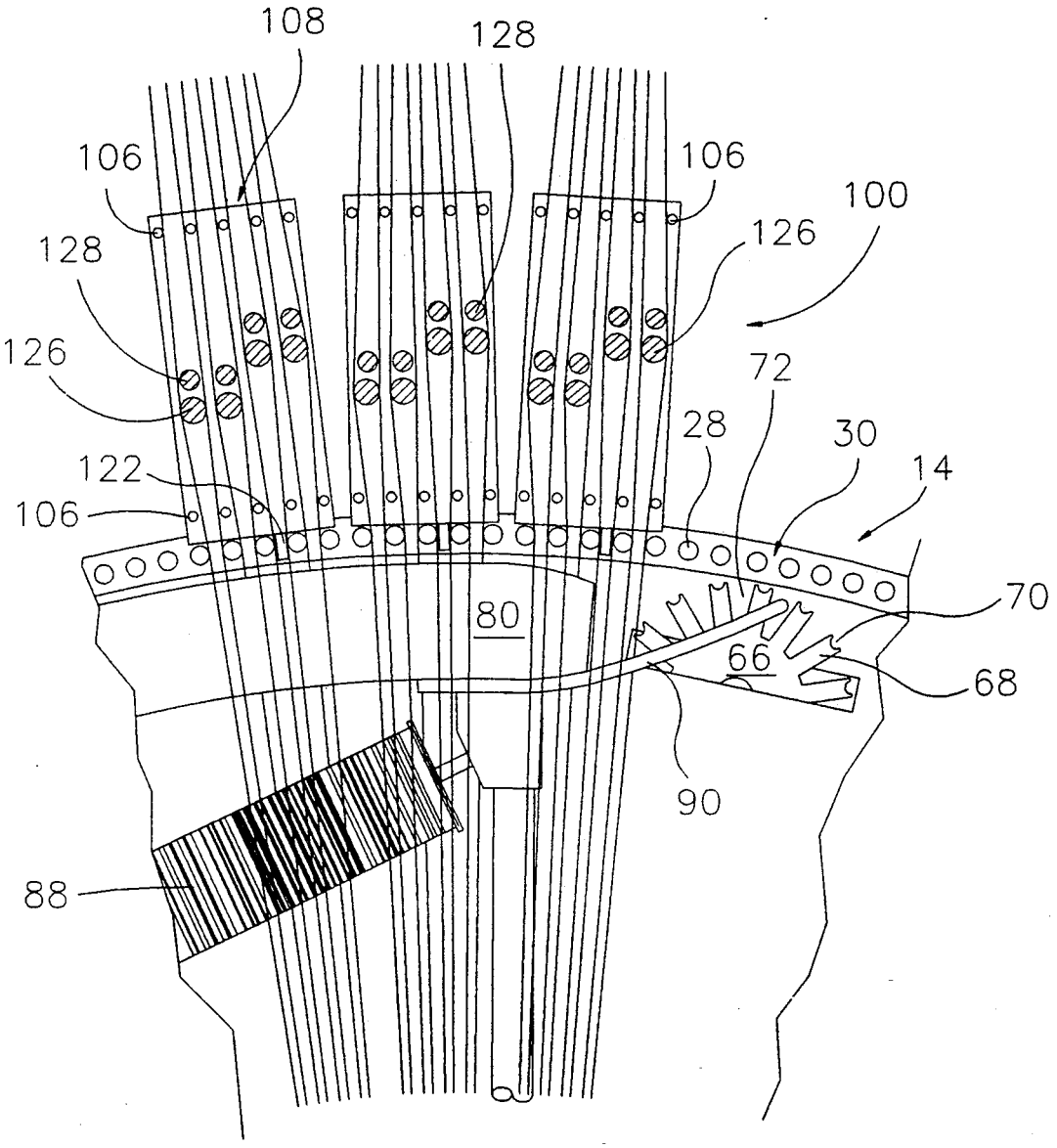
FIG. 5 is a schematic plan view of a portion of a circular loom having a plurality of individual warp yarn selectors mounted thereto.

Referring now to the drawings, and particularly to FIGS. 1–4, a circular loom incorporating a warp yarn selector is shown therein and indicated generally by the numeral 10. The loom 10 includes a frame 12 which supports a circular reed 14. Circular reed 14 is stationary and includes a plurality of circumferentially spaced reed pins 28 defining a plurality of warp slots 30. Reed pins 28 are fixed at the lower end to a ring or cylinder 26 which is mounted to frame 12. A top ring 32 is secured to the upper end of the reed pins 28. A shuttle track ring 34 is secured on top of the reed 14.

The reed 14 directs radially-extending warp yarns to the point where a weft yarn is inserted to form a tubular fabric. The weft yarn is inserted by means of a shuttle which travels in a circular path inside the reed 14. The shuttle is supported by a shuttle carrier 16 that is rotatably mounted within the circular comb or reed 14. The shuttle carrier 16 is fastened to a housing 38 by screws 40. The housing 38 is rotatably mounted by bearings on a stationary main drum 44. A weaving cone 48 is supported by a collar 46 at the top of the main drum 44.

The shuttle carrier 16 is driven by an electric motor and first power transmission assembly 52. Power transmission assembly 52 includes a drive gear 56 which meshes with a ring gear 58 secured to the turntable housing 38. A second power transmission means 60 including a gear 62 is driven by the ring gear 58. The second power transmission means 60 drives the take up means 24 synchronously with the shuttle carrier 16 to take up the tubular fabric as it is being woven.

A warp supply means is provided for supplying warp yarns to the loom 10. Warp yarns for weaving the tubular fabric are stored on a creel (not shown) which is disposed below the circular loom 10. The warp yarns extend upwardly through perforated plates in the floors and around a tensioning roll 62. The warp yarns then pass over tensioning rods 64 and extend radially through respective slots 30 in the circular reed 14.

As previously indicated, the tubular fabric is formed by interleaving a circumferentially extending weft yarn with the warp yarns. To interleave the weft yarn, the warp yarns must be divided into two sheets which can then be separated so that the weft yarn can be inserted.

The warp yarns are separated into two sheets by a shed-forming means 20. Shed-forming means 20 comprises a pair of shedding wheels 66 which are rotatably mounted on the shuttle carrier 16. The shedding wheels 66 are disposed at an angle relative to the reed 14. Each shedding wheel 66 includes a series of radially projecting teeth 68 which engage the reed pins. Due to the engagement of the teeth 58 with the reed pins, the shedding wheel 58 rotates at a speed which corresponds directly to the speed of the shuttle carrier 16. As the shedding wheels 66 rotates, every other warp yarn will be caught in the notch 70 formed in the outer end of the tooth 58. The alternate warp yarn will fall into the slot 72 formed between the teeth 68 of the sheeding wheel 66. The warp yarns received by the radially projecting teeth 58 of the shedding wheel 66 will be raised for form the top sheet of the weaving shed. The warp yarns falling into the slot 72 between the teeth 68 of the shedding wheel 66 will form the bottom sheet of the weaving shed.

Shedding wheels 66 are disposed approximately 180° appart on the turntable 16. The warp yarns are threaded through the comb 14 such that the shedding wheels raise and lower opposite groups of warp yarns. Thus, the passing of each shedding wheel 66 will change the shed. That is, the warp yarns in the top and bottom sheets during the passing of the first shedding wheel 66 will switch positions during the passing of the second shedding wheel 66. Since there are two shedding wheels 66, the weaving shed will change twice during each complete revolution of the turntable.

Shedding wheels 66 are mounted to the shuttle carrier 16 directly in front of the shuttle 80. Shedding wheels 66 form a preliminary shed which must be further opened to allow the passing of the shuttle 80 through the weaving shed. A shed opener 90 extends from the front end of the shuttle 80 for opening the shed. The shed opener 90 includes upper and lower guide rails 92 and 94 which meet at a point 96. Point 96 of the shed opener 90 is positioned such that the warp yarns caught by the arms of the shedding wheel 66 pass over the upper guide rail 92, while the warp yarns in the slots 72 of the shedding wheel 66 pass under the lower guide rail 94. The upper and lower guide rails 92 and 94 taper outwardly as they extend towards the shuttle to spread the warp yarns apart to open the shed as the shuttle 80 passes through. As the shuttle 80 moves through the weaving shed, the weft yarn is unwound from the spool 88 and is transferred by the circular motion of the shuttle 80 to the edge of the tubular fabric. After the shuttle 80 passes through the shed, the shed changes so that the weft yarn is interleaved into the tubular fabric. The tubular fabric so formed is taken up by the take-up means 24. The woven tubular fabric passes around an idle roller 104 and is wound through a series of take up rollers 106 as shown in FIG. 1.

The structure and function of the loom 10 just described is conventional and well known to those skilled in the art and therefore a detailed discussion of the loom per se is not necessary. Circular looms substantially as described are made by Mandals Reberbane Christisian & Co. A/S and sold under the trade name "Hosemaker." Since the structure and function of the circular loom is well known to those skilled in the art, further explanation of the loom is omitted.

Figure 6:
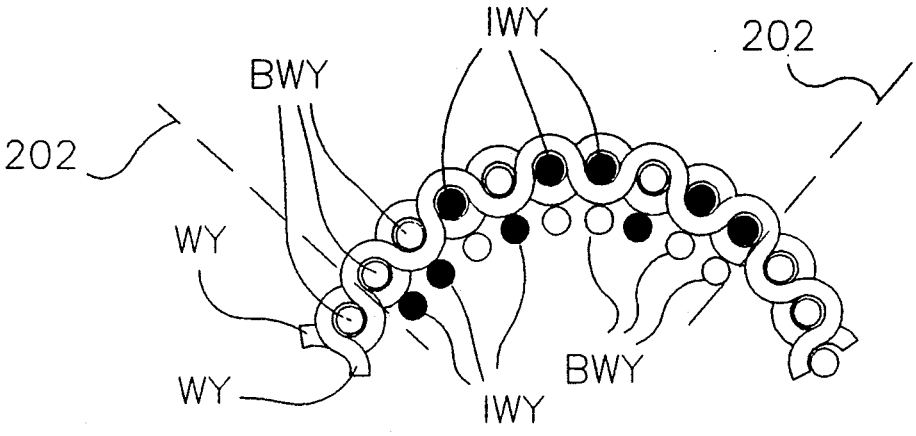
FIG. 6 is a schematic cross sectional view of a woven tubular fabric showing how certain base warp yarns and indicia forming warp yarns are selected to form a woven indicia within the surface of a tubular product such as a fire hose.

In the past, circular looms have been used for weaving tubular fabric and any indicia would be stenciled or painted onto the outer surface. This limitation is overcome in the present invention by incorporating a warp yarn selector into the circular loom for weaving indicia directly into the woven tubular fabric. A yarn selector 100 is used in connection with a new method for weaving tubular fabrics to produce tubular fabrics bearing woven indicia or designs. The process involves pairing the base warp yarns in a selected portion of the tubular fabric with an indicia forming warp yarn of a different color. On each pass of the shuttle 80, selector 100 exclusively selects one and only one warp yarn from each pair to interleave with the weft yarn. The unselected warp yarn is allowed to float along the inside of the tubular fabric and is not interleaved with the weft yarn. FIG. 6 shows a cross-section of a tubular fabric produced according to the present invention. As can be clearly seen in the drawings, only one warp yarn from each pair of warp yarns is interleaved with the weft yarn. For purposes of reference, the warp yarns comprise two types, the base warp yarns (BWY) and the indicia forming yarns (IWY). The weft yarns are referred to by WY. By selecting which one of the warp yarns, IWY or BWY, is interleaved with the weft yarn at a given location on the tubular fabric, characters or other indicia can be woven into the fabric.

Referring now to FIGS. 3–7, the selector 100 for selecting the warp yarn to be woven into the tubular fabric is shown. Selector 100 includes a frame comprising an upper mounting plate 102, a lower mounting plate 104, and a plurality of guide rods 106 extending between the upper and lower mounting plates 102 and 104. A positioning pin 122 extends from the back edge of the upper mounting plate 102 for positioning the selector 100 on the reed 14. The positioning pin 122 fits between the reed pins 28 of the reed 14 to align the selector 100 relative to the reed 14.

Figure 7:
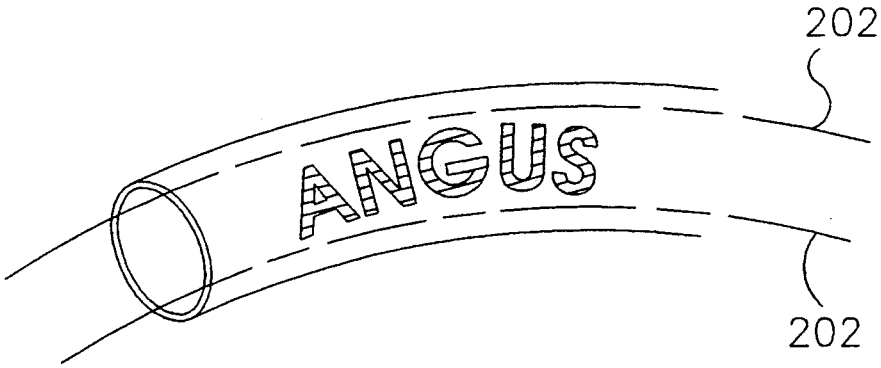
FIG. 7 is a illustration of a fire hose having a woven indicia according to the present invention incorporated therein.
Figure 8:
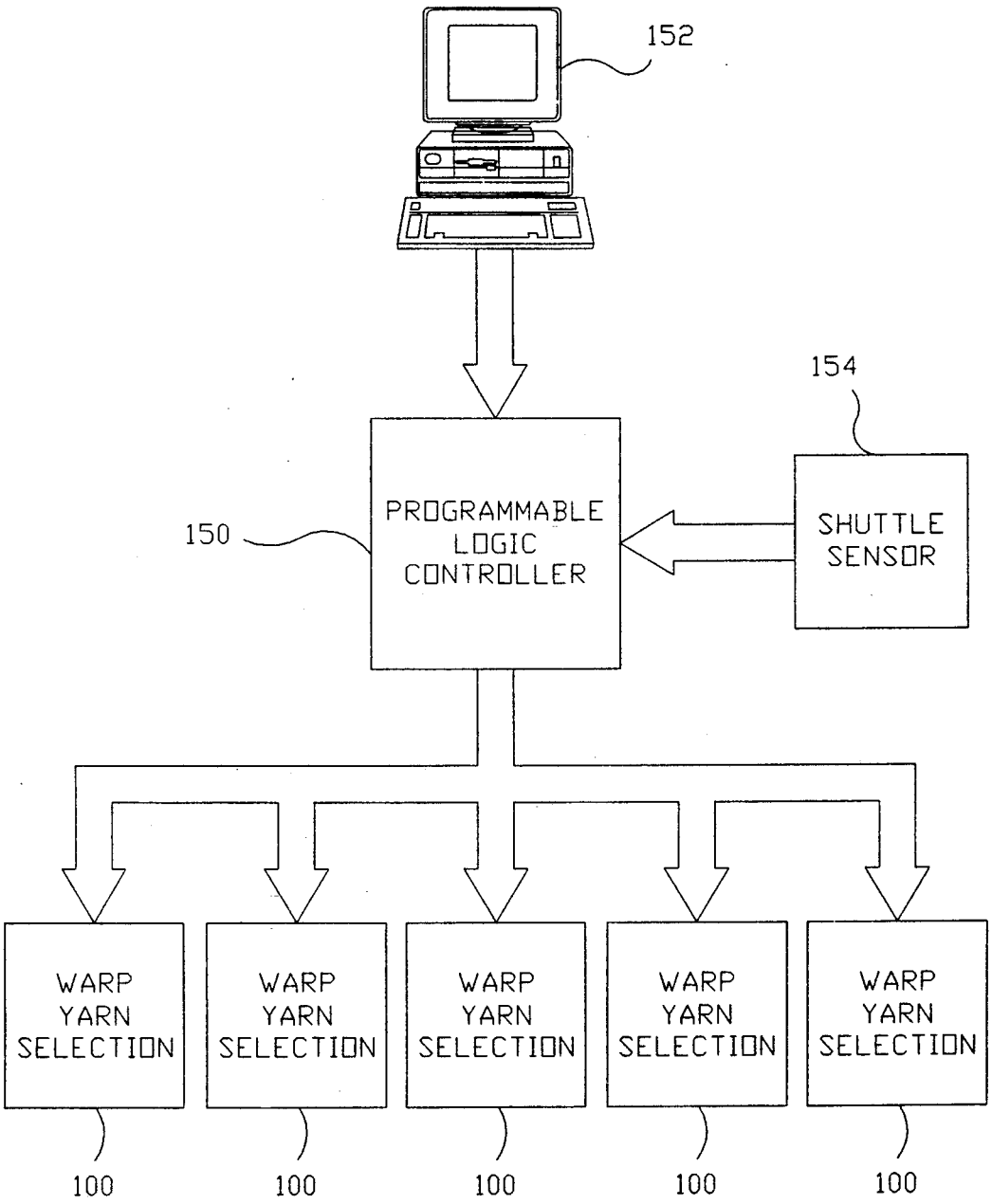
FIG. 8 is a schematic illustration of a computer and programmable controller for controlling the warp yarn selector of the present invention.

In the embodiment shown, five guide rods are laterally spaced along the front and back edges of the mounting plates 102 and 104. The guide rods 106 define four warp guide slots 108. Thus, the selector 100 of the present invention can handle four pairs of warp yarns. The number of warp yarns handled by the selector 100 is not a material part of the invention and the selector 100 can be easily modified to handle a larger or smaller number of warp yarns. It is appreciated that individual selectors 100 can be placed side-by-side on the loom 10 as shown in FIG. 7 to accommodate a large quantity of warp yarns.

A support plate 110 is supported in spaced relation to the upper mounting plate 102 by a support block 112. A conventional bolt and nut fastener 114 secures the support plate 110 and support block 112 to the upper mounting plates 102. A pair of securing screws 116 are threadably engaged with corresponding screw holes 118 along the front end of the support plate 110. The function of the securing screws 116 is to secure the selector 100 to the reed 14. The selector's entire frame assembly is mounted to the reed 14 of the circular loom 10. Mounting plates 102 and 104 fit between the top and bottom rings of the reed 14 respectively. The securing screws 116 are then tightened against the top ring 32. The positioning pin 122 fits between the guide pins 28 of the reed 14 to position the selector 100.

A selector mechanism 124 is mounted within the selector frame assembly 120. Selector mechanism 124 includes four shielding rods 126 and four selector rods 128. Each shielding rod 126 is paired with one selector rod 128, and each pair of rods is disposed along the centerline of one of the warp guide slots 108. The selector rods 128 are stationary and have their ends fixed to the upper mounting plate 102 and lower mounting plate 104 respectively. The shielding rods 126, on the other hand, slide freely up and down within guide holes 132 formed in the upper and lower mounting plates 102 and 104. The lower end of the shielding rods 126 extend below the lower mounting plate 104. A spring 140 is inserted over the lower end of the shielding rods 126 and is retained by a retaining ring 142. Biasing spring 140 biases the shielding rods 126 to the lower position. The upper end of the shielding rods 126 are secured to a connecting block 134. Two shielding rods 126 are connected to each connecting block 134 so that two adjacent shielding rods 126 move up and down together. The connecting blocks 134 are connected to an actuator rod 138 which is actuated by a solenoid 136. When the solenoid 136 is turned on, the shielding rods 126 are lifted by the actuator rod 138. The shielding rods 126, under the influence of springs 140, return to the lower position when the solenoid 136 is turned off.

The shielding rods 126, in combination with the selector rods 128, select one warp yarn from each pair to be interleaved with the weft yarn WY. Each selector rod 128 is formed with first and second catches **128*a* and 128*b* which are disposed on opposite sides of the selector rod 128. Each shielding rod 126 includes cut outs 126*a* and 126*b* disposed on opposite sides of the shielding rod 126. When the shielding rod is in the lower position, cut-out 126*a* exposes the catch 128*a* on the associated selector rod. Conversely, when the shielding rod 126 is in a raised position, catch 128*b* on the selector rod 128 is exposed by the cut out 126*b*. Only one catch 128*a* or 128*b*** will be exposed at a time so that only one yarn from each pair is woven into the fabric.

In operation, four pairs of warp yarns are threaded through the guide slots 108 of the selector 100. The warp yarns of each pair are extended around opposite sides of the rods 126 and 128. For example, the base warp yarn BWY may pass on the right side of the shielding rod 126 and selector rods 128 while the indicia-forming yarn IWY passes around the left side. The warp yarns are then threaded through the loom in the usual manner.

As the loom operates, the warp yarns move up and down within the warp guides slots 108 of the selector 100 as the weaving shed alternates. When the shielding rod 126 is in the lower most position, the indicia-forming warp yarns IWY will be caught in the catch **128*a* of the selector rod 128. The opposite catch 128*b* will be shielded by the shielding rod 126. Thus, the primary warp yarn or base warp yarn BWY will continue to move up and down in the usual manner and will be woven into the tubular fabric. The indicia-forming warp yarn IWY, which is held in the catch 128***a*, is lifted to a height so that it will always pass over the top of the shuttle 80. As long as the indicia-forming yarn IWY is held, it will not be interleaved with the weft yarn. Instead, the indicia-forming yarn IWY will float along the inside of the tubular fabric (See FIG. 6).

When the shielding rod is in a raised position (See the right hand half of the selector 100 in FIG. 3), the indicia-forming yarn IWY will be woven into the tubular fabric while the base warp yarn BWY is floated along the inside of the tubular fabric. The base warp yarn BWY will get caught in the catch 128*b* of the selector rod 128. Catch 128*a* will be shielded by the shielded rod allowing the indicia-forming warp yarn IWY to freely move up and down in the warp guide slots 108. Thus, the indicia-forming warp yarn IWY is interleaved with the weft yarn WY into the tubular fabric, and the base warp yarn BWY is floated (i.e. not woven) on the inside of the tubular fabric.

Control of the selector 100 is accomplished by means of a programmable logic controller 150 which turns the solenoids 136 on or off according to a predetermined pattern. The pattern is generated by a personal computer 152 and then stored as an array in the programmable logic controller's memory. FIG. 9 illustrates an array which might be used to weave the letter "A" into the tubular fabric. The array contains a series of binary digits. The horizontal rows of the array represent each pass of the shuttle. The vertical columns represent one solenoid 136 which controls two warp yarn pairs. The rows and columns are designated by reference numerals. A "0" stored at a particular coordinate position means that the corresponding solenoid 136 is turned off for a particular pass of the shuttle. A "1" means that the solenoid 136 is turned on. For example, in FIG. 9, "0" is stored at row 12, column 05. Thus, on the 12th pass of the shuttle 80, the solenoid 136 controlling two corresponding warp yarn pairs will be turned "off". A "1" is stored at row 12, column 04 which will cause the corresponding solenoid 136 to be turned "on" during the 12th pass of the shuttle.

Figure 10:
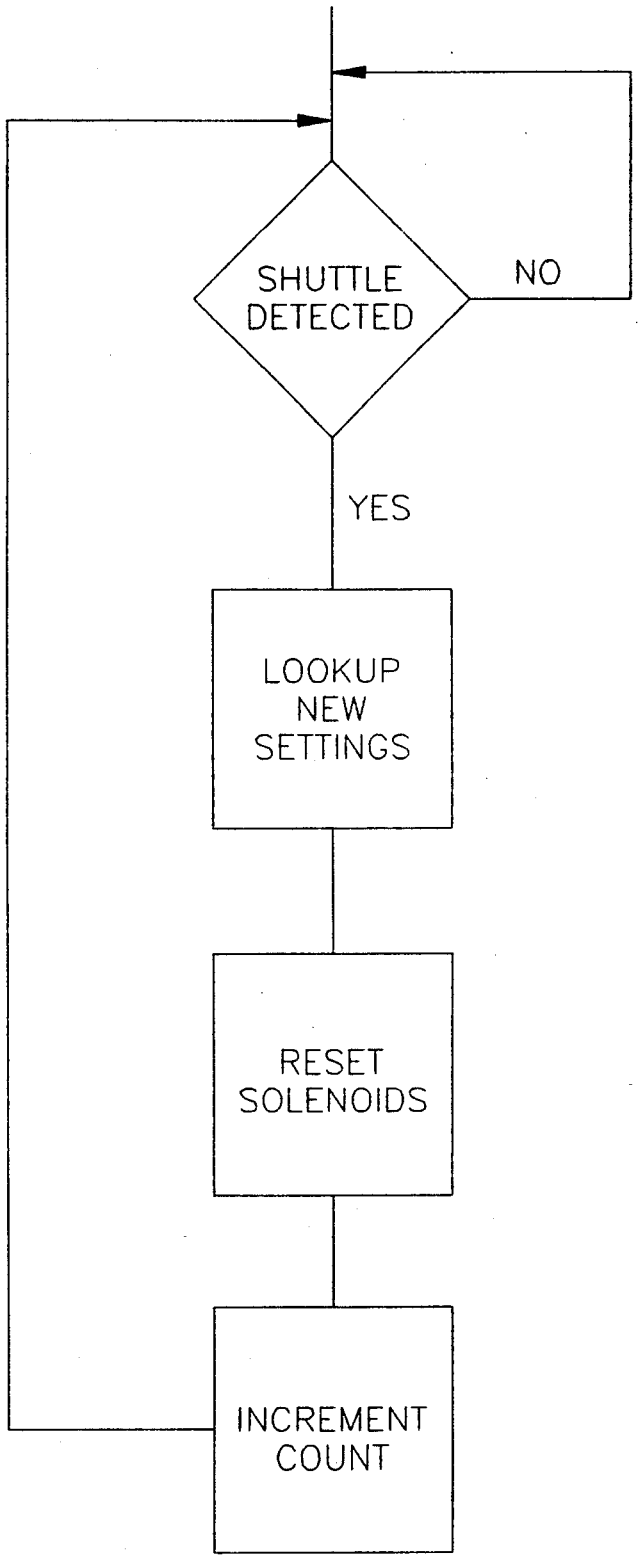
FIG. 10 is a schematic flow chart showing the basic steps involved in controlling the warp yarn selector to cause a selected indicia to be formed within a circular product or fabric.

To sense the passing of the shuttle 80, a detector 154 is mounted under loom 10 near a pointer on gear 58 to sense shuttle 80 passing selector 100. When the shuttle 80 passes, an electrical signal is sent to the programmable controller 150. As shown in FIG. 10, the programmable controller 150 stays in a wait state until the passing of the shuttle 80 is detected. When the shuttle 80 is detected, the programmable controller 150 looks up to the proper settings for each solenoid 136 which is stored in the programmable controller's memory and then resets all of the solenoids 136. The count is then incremented by one and the programmable controller 150 returns to a wait state until the next pass of the shuttle 80.

Therefore, the present method and apparatus utilizes special indicia forming warp yarns to create a woven name, design or symbol within a woven tubular fabric. Specifically along an elongated warp yarn segment strip, the indicia forming warp yarns are selectively woven and floated (unwoven) to form the selected woven indicia in the tubular fabric. See, for example, FIG. 7 where the mark "Angus" has been woven into the woven fabric of a fire hose. Note that the "Angus" indicia formed on the fire hose is actually formed by the indicia forming warp yarns IWY which are of a different color than the base warp yarns BWY which effectively form that background for the indicia. It should be noted that in the approach illustrated in this disclosure that the respective weft yarns are tightly tucked such that their exposure from the outside of the tubular fabric is minimum. In any event, the weft yarns can be colored the same color as the base warp yarns so as to cooperate with the base warp yarns to form the contrast against which the formed indicia lies. Referring back to FIG. 7 and the illustration of the "Angus" indicia, note that the two construction lines 200 and 202 define the indicia warp yarn segment which essentially comprises that elongated segment of the tubular fabric consisting of both the base and indicia forming warp yarns that cooperate to form the woven indicia.

As already discussed, for each warp increment in the indicia warp yarn segment, the present process envisions feeding a pair of warp yarns into the loom, one warp yarn being a base warp yarn while the other is an indicia forming warp yarn. The selector 100 in response to the program controller and is controlled so as to weave the indicia forming warp yarns into selective positions on the tubular fabric and always while a certain indicia forming warp yarn is being woven, its mated base yarn is being floated or unwoven along the inside of the tubular fabric adjacent the formed indicia forming warp yarns. Likewise, when the base warp yarns are being woven in the indicia forming warp segment, defined between lines 200 and 202 of FIG. 7, the mating indicia forming yarns are likewise being floated or non-woven along the adjacent inside area of the woven fabric. This is particularly illustrated in FIG. 6 where it is seen that across the indicia forming warp segment that both base warp yarns and indicia forming yarns are interwoven with the weft yarns WY. Adjacent the woven base warp yarns and indicia forming warp yarns, one finds floating or non-woven yarns which differ from the warp yarns actually woven.

As already discussed, to select a particular warp yarn, that is a base warp yarn or an indicia forming warp yarn, the selector 100 effectively catches the non-selected warp yarn and holds it at an elevation sufficient to assure that it will not be pulled in the alternating shed forming process. This effectively assures that the non-selected warp yarn will not be interwoven with the weft yarn, and consequently, the non-selected warp yarns will be pulled into the loom and effectively floated or non-woven with the tubular fabric.

It is appreciated that all types of names, designs and symbols can be interwoven into a fire hose or any other tubular fabric according to the present invention. In addition, the basic process disclosed is compatible with computer technology and standard control systems that enable a predetermined design to be effectively stored into a computer and form the basis for automatically controlling the selector 100 to produce a desired design.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. In a circular weaving process for forming a tubular woven product, a method of circularly weaving an indicia into said tubular product comprising the steps of:

(a) for each warp yarn increment about a selected warp segment of the tubular product, directing a pair of warp yarns into a circular loom, one yarn being a base yarn and the other yarn being a different and contrasting indicia forming yarn;

(b) circularly weaving the base warp yarns with weft yarns to form a tubular product and floating the indicia forming yarns during this process by selectively removing the indicia forming yarns from the circular weaving process and running them in an unwoven fashion along the inside wall of the tubular product;

(c) forming an indicia in the wall of the tubular product by selectively floating certain base warp yarns and weaving certain indicia forming warp yarns with the weft yarns to form an indicia on the tubular woven product while the corresponding floating base warp yarns run in an unwoven fashion along the inside wall of the tubular product; and (d) selectively alternating the base and indicia forming warp yarns between weaving and floating modes to form the selected indicia on the tubular woven product.

2. The method of claim 1 wherein the step of floating a selected warp yarn includes engaging the selected warp yarn and moving the engaged warp yarn to a position where it cannot be interwoven with a weft yarn and maintaining the floating yarn in that non-weaving position for a selected period.

3. The method of claim 1 including the step of directing each pair of base and indicia forming yarns passed a selector rod and selectively engaging one of the pair of yarns with the rod and holding the engaged yarn in a floating, non-weaving position.

4. The method of claim 3 including holding the selected floating yarn to one side of a circulating shuttle and preventing the yarn being held from moving back and forth to be interwoven with the weft yarn carried by the circulating shuttle.

5. The method of claim 1 including the step of directing the base and indicia forming yarns of each pair past opposite sides of a selector rod having catch notches formed on opposite sides, and selectively shielding the notches of the rod so as to leave only one catch notch in an open position and catching the selected floating yarn within the open catch notch and holding the caught yarn at a position where it may not be interwoven with a weft yarn.

6. The method of claim 5 including the step of moving a shielding device up and down about the selector rod so as to selectively shield a yarn notch.

7. The method of claim 1 including providing a series of the yarn pairs around a selective portion of the loom and automatically controlling the selection of the base and indicia forming yarns of the yarn pairs through an automatic controller programmed to produce a selected indicia or design.

8. The method of claim 1 wherein the step of selecting particular yarns to be floated occurs outside the comb of a circular loom.

9. The method of claim 8 including running each pair of base and indicia forming yarns by a selector and selectively engaging one and only one yarn of each pair and holding the engaged yarn in a position where the same cannot be interwoven with the weft yarn.

10. The method of claim 9 including circling a shuttle carrying the weft yarn between radially extending warp yarns and alternatively moving said warp yarns up and down such that the weft yarn can be interwoven between the moving warp yarns and wherein the method includes holding the engaged warp yarn that is selected to be a floating yarn in a position above the passing shuttle such that the engaged selected floating yarn cannot be interwoven with the passing weft yarn.

11. A warp yarn selector for use in conjunction with a circular loom for weaving indicia a woven tubular product comprising:

(a) a yarn inlet for receiving pairs of warp yarn with each warp yarn pair including a base yarn and an indicia forming yarn;

(b) an outlet for allowing extension of the pairs of warp yarns into a loom (c) selector means including one exclusive selector element for each pair of yarns comprising yarn catch means including a plurality of engaging members for selecting only one warp yarn from each pair and position that selected warp yarn so that it is not interwoven into the tubular product but is floated to the inside of the tubular product where the floated yarn runs in an unwoven state while at the same time directing the other yarn to be interwoven into the tubular product.

12. The invention of claim 11 including control means for automatically controlling the selector means to produce a predetermined woven indicia in the woven tubular product.

13. The invention of claim 11 wherein each member comprises a rod adapted to handle a pair of base and indicia forming yarns, each rod having both a base yarn catch and an indicia forming yarn catch and wherein the selector means is operative to float either the base yarn or the indicia forming yarn by catching either in the respective catches formed in a rod.

14. The invention of claim 13 including catch shielding means associated with each rod and moveable between a base yarn catch shielding position and an indicia forming yarn catch position wherein the catch shielding means is operative to shield one catch associated with each rod while weaving the other catch exposed and wherein the exposed catch is operative to hold a selected yarn in the floating or non-weaving position.

15. The invention of claim 14 including solenoid means operatively connected to the shielding means for moving the same between the base yarn catch shielding position and the indicia forming yarn catch shielding position.

16. The invention of claim 11 wherein the engaging members include a plurality of rods with each rod having a pair of yarn catches formed therein and adapted to control one pair of warp yarns; a shielding member movably mounted adjacent each rod and moveable between a first position where it shields one catch and a second position where it shields the other catch; actuating means for moving the shielding member between the first and second position; and wherein each rod is operative to catch and hold one yarn of the pair in the exposed non-shielded catch at any one time leaving the other yarn of the pair in an unrestrained mode such that it can move up and down and accordingly be weaved within the tubular product being woven by the loom.

17. A circular loom for weaving tubular fabrics having a predetermined woven design, comprising:

(a) a circular reed having a plurality of warp guide slots for guiding a plurality of radially extending warp yarns into the loom;

(b) shed-forming means for forming a shed in said warp yarns;

(c) filling means including a shuttle which travels in a circular path inside the reed for inserting a circumferentially extending weft yarn in the shed formed by the shed-forming means to form the tubular fabric;

(d) a warp yarn selector for receiving pairs of warp yarns including a base yarn and an indicia-forming yarn and directing each pair of warp yarns into the circular loom, the warp yarn selector including means for selecting one of the pair of yarns to interleave with the weft yarn on each pass of the shuttle while manipulating and moving the other warp yarn of the pair out of the path of the shuttle so as to prevent the non-selected warp yarn from being woven with the weft yarn such that the other warp yarn remains floating in an unwoven state within the tubular fabric; and (e) control means for actuating the warp yarn selector and controlling the selection of the base and indicia forming warp yarns so as to yield a selected indicia on the tubular fabric.

18. The circular loom of claim 17 wherein said warp yarn selector includes mounting means for mounting the warp yarn selector to the outside of the circular reed.

19. The circular loom of claim 17 wherein the warp yarn selector means includes catch means for catching the non-selected warp yarn and holding the nonselected warp yarn to one side of the shuttle while the selected yarn moves up and down within the shed so as to be interwoven with a weft yarn.

20. The circular loom of claim 19 wherein the catch means includes an elongated selector rod interposed between the base warp yarn and the indicia-forming warp yarn, said elongated selector rod including first and second warp yarn catches disposed on opposing sides of the selector rod for catching the non-selected warp yarn.

21. The circular loom of claim 20 further including shielding means for shielding the catch for the selected warp yarn.

22. The circular loom of claim 21 wherein the shielding means comprises a shielding rod disposed adjacent to the selector rod and having a diameter at least as great as the selector rod, said shielding rod including first and second cut-outs and adapted to be moveable between a first position in which the first one of the cut-outs aligns with one of the catches in the selector rod, and a second position in which a second one of said cut-outs aligns with the other catch in the selector rod.

23. The circular loom of claim 22 wherein the shielding rod is biased to a selected position.

24. The circular loom of claim 23 wherein the control means includes an electrical actuator for moving the shielding rod from the biased position.

* * * * *